US010014142B2

(12) United States Patent
Lee

(10) Patent No.: US 10,014,142 B2
(45) Date of Patent: Jul. 3, 2018

(54) ADJUSTABLE THERMAL TRIP MECHANISM FOR CIRCUIT BREAKER

(71) Applicant: LSIS CO., LTD., Anyang-si, Gyeonggi-do (KR)

(72) Inventor: Kwangwon Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/585,103

(22) Filed: May 2, 2017

(65) Prior Publication Data

US 2017/0323753 A1 Nov. 9, 2017

(30) Foreign Application Priority Data

May 4, 2016 (KR) ..... 20-2016-0002435 U

(51) Int. Cl.
*H01H 71/74* (2006.01)
*H01H 69/01* (2006.01)
*H01H 37/52* (2006.01)

(52) U.S. Cl.
CPC ..... *H01H 71/7427* (2013.01); *H01H 69/01* (2013.01); *H01H 37/52* (2013.01);
(Continued)

(58) Field of Classification Search
CPC ..... H01H 71/7427; H01H 71/7445; H01H 2071/7481; H01H 71/74; H01H 71/7418;
(Continued)

(56) References Cited

U.S. PATENT DOCUMENTS 4,698,606 A * 10/1987 Mrenna ..... H01H 71/7427 335/45
4,922,220 A * 5/1990 Livesey ..... H01H 71/74 335/45

(Continued)

FOREIGN PATENT DOCUMENTS

CN 202443931 9/2012
CN 102810436 12/2012

(Continued)

OTHER PUBLICATIONS

European Search Report for related European Application No. 17168137.2; report dated Oct. 11, 2017; (5 pages).

*Primary Examiner* — Anatoly Vortman
*Assistant Examiner* — Jacob Crum
(74) *Attorney, Agent, or Firm* — K&L Gates LLP

(57) ABSTRACT

An adjustable thermal trip mechanism for a circuit breaker is provided which can improve the reliability of over-current tripping by minimizing an influence upon thermal tripping even if an assembly error such as skewing or twisting occurs during assembly of bimetallic strips. The adjustable thermal trip mechanism for the circuit breaker comprises: a crossbar that is rotatable and has at least one power receiving portion for receiving rotary power; a bimetallic strip that can bend towards the power receiving portion when an over current occurs on the circuit; and an adjustment screw installed to face the power receiving portion, wherein the power receiving portion comprises a plurality of planar portions which are at different distances from the adjustment screw.

2 Claims, 8 Drawing Sheets

(52) U.S. Cl.
CPC ..... *H01H 71/74* (2013.01); *H01H 71/7445* (2013.01); *H01H 2071/7481* (2013.01)

(58) Field of Classification Search
CPC ..... H01H 71/7436; H01H 2071/7454; H01H 69/01; H01H 37/52
USPC ..... 337/360
See application file for complete search history.

(56) References Cited

U.S. PATENT DOCUMENTS

| | | | | |
|---|---|---|---|---|
| 5,193,043 | A * | 3/1993 | Grunert | H01H 83/223 361/105 |
| 6,208,228 | B1 * | 3/2001 | Gula | H01H 71/505 335/132 |
| 6,255,925 | B1 * | 7/2001 | DiMarco | H01H 71/7463 335/176 |
| 6,445,274 | B1 * | 9/2002 | Malingowski | H01H 71/7445 335/202 |
| 8,143,980 | B2 * | 3/2012 | Tetik | H01H 71/40 335/10 |

FOREIGN PATENT DOCUMENTS

| | | |
|---|---|---|
| CN | 203491203 | 3/2014 |
| CN | 103903927 | 7/2014 |
| DE | 102014204026 A1 | 9/2015 |
| EP | 0389185 A1 | 9/1990 |
| JP | 2753603 | 5/1998 |
| JP | 2000003655 | 1/2000 |

* cited by examiner

ADJUSTABLE THERMAL TRIP MECHANISM FOR CIRCUIT BREAKER

CROSS-REFERENCE TO RELATED APPLICATION

Pursuant to 35 U.S.C. § 119(a), this application claims the benefit of earlier filing date and right of priority to Korean Application No. 20-2016-0002435, filed on May 4, 2016, the contents of which are all hereby incorporated by reference herein in its entirety.

BACKGROUND OF THE INVENTION

1. Field of the Invention

The present invention relates to a circuit breaker, and more particularly, to an adjustable thermal trip mechanism for a molded case circuit breaker.

2. Description of the Conventional Art

The present invention concerns a circuit breaker, and more particularly, an adjustable thermal trip mechanism for a molded case circuit breaker (hereinafter, abbreviated as MCCB or circuit breaker).

The MCCB comprises a switching mechanism, a trip mechanism, and an arc extinguishing mechanism as main functional parts.

Here, the switching mechanism is a circuit switching mechanism comprising a stationary contact arm, a movable contact arm, a spring that drives the movable contact arm to an open or closed position, and drive mechanisms such as a link, a lever, a latch, a handle, a shaft, etc.

The trip mechanism is a mechanism that triggers the switching mechanism to operate in a position where it automatically breaks a circuit (so-called, trip position), in response to an abnormal current on the circuit.

The arc extinguishing mechanism is a mechanism that prevents delay in circuit breaking caused by an arc by extinguishing an arc generated between the stationary contact arm and the movable contact arm when trips or breaks the circuit while current flows on the circuit. The arc extinguishing mechanism is configured by a stack of a plurality of ferromagnetic plates—a so-called arc grid—, installed near the stationary contact arm and the movable contact arm.

The present invention relates to the trip mechanism, among these main mechanisms of the molded case circuit breaker. This trip mechanism can be categorized into a thermal trip mechanism, which is a time-delayed trip mechanism, that triggers the switching mechanism to trip in response to over-currents flowing through the circuit, which are about 120% of the rated current, and an instantaneous trip mechanism that triggers the switching mechanism to trip more rapidly than the thermal trip mechanism in response to large fault currents on the circuit, such as fault currents up to several times or several tens of times the rated current.

Here, the thermal trip mechanism uses bending due to thermal expansion of bimetallic strip caused by over current, and the instantaneous trip mechanism uses the magnetic force of an electromagnet proportional to large currents to attract and move an armature to the electromagnet.

Circuit breakers are provided with both or at least one of the thermal trip mechanism and the instantaneous trip mechanism.

The present invention relates to the thermal trip mechanism, among these trip mechanisms. The background art of the thermal trip mechanism will be described with reference to FIGS. 1 to 9.

First of all, referring to FIG. 1, a circuit breaker 100 is provided with an adjustment dial 10 on the top cover to set the rated current, and MIN, MED, and MAX marks are shown on the top cover around the adjustment dial 10, as can be seen in the magnified circle.

Meanwhile, the configuration of a thermal trip mechanism will be described below, referring mostly to FIGS. 2 and 3 but sometimes to FGS. 4 and 5. FIG. 2 is a perspective view from a terminal side, illustrating only the adjustment dial, crossbar, and thermal trip mechanism in the circuit breaker to which the conventional art and the present invention can be applied. FIG. 3 is a perspective view obliquely viewing down from above a heater, illustrating only the adjustment dial, crossbar, and thermal trip mechanism in the circuit breaker to which the conventional art and the present invention can be applied.

The thermal trip mechanism comprises an adjustment dial 10, a crossbar 20, bimetallic strips 22, adjustment screws 23, and heaters 24.

The thermal trip mechanism may further comprise a spring 21 that elastically supports one end of the crossbar 20.

Referring to FIG. 2, the adjustment dial 10 includes a connecting protrusion 10*a* eccentrically located and extending downward so that it moves in interlocking with the crossbar 20.

The crossbar 20 is a bar-shaped member that can be rotated to trigger the switching mechanism to trip. The crossbar 20 comprises a pair of dial connecting protrusions 20*a*, a plurality of power receiving portions 20*b*—which may be three corresponding to AC three phases, and a spring pass-through end 20*c*.

The pair of dial connecting protrusions 20*a* are formed with a pair of protrusions spaced apart from each other and protruding from a shaft portion of the crossbar 20 such that the connecting protrusion 10*a* of the adjustment dial 10 is connected by fitting in between the pair of protrusions.

When the adjustment dial 10 is rotated while the connecting protrusion 10*a* of the adjustment dial 10 is connected to the pair of protrusions by fitting in between the pair of protrusions, the crossbar 20 moves to the left or right by a force from the connecting protrusion 10*a* of the adjustment dial 10 pushing the crossbar 20 to the left or right.

Each of the plurality of power receiving portions 20*b* is configured with a plate that protrudes upward from the shaft portion of the crossbar 20.

Referring to FIG. 5, Each of the plurality of power receiving portions 20*b* has a planar surface portion 20*b*-1 and a slant surface portion 20*b*-2.

The spring pass-through end 20*c* is one end of the crossbar 20, which may have a smaller diameter than the shaft portion of the crossbar 20 so that it can move left and right within the spring 21.

As the crossbar 20 moves to the left or right by the rotation of the adjustment dial 10, the spring pass-through end 20*c* may move to the left so as to be inserted deep inside the spring 21 or move to the right so as to be inserted in it only a little bit, as shown in FIG. 2.

Referring to FIG. 4, the bimetallic strip 22 is configured in such a way that the lower part is attached tightly to the heater 24 and the upper part bends freely towards the crossbar 20, with a predetermined distance from the heater 24.

Referring to FIG. 9, the bimetallic strip 22 is fixed such that the lower part is attached tightly to the heater 24 by a pair of rivets R.

The bimetallic strip 22 is thermally expanded when the heater 24 attached tightly to the lower part is heated by over-current on the circuit, and this allows the upper part, which is a free end, to bend towards the crossbar 20.

The bimetallic strip 22 includes a threaded hole portion at the upper end to mesh the adjustment screw 23 with the threaded hole portion.

The adjustment screw 23 is coupled to the threaded hole portion formed at the upper end of the bimetallic strip 22, and the adjustment screw 23 has a screw head portion with a driver insertion slot portion that allows a screwdriver to fit into the driver insertion slot portion.

By rotating the adjustment screw 23 in clockwise or counter clockwise with the screw driver, the adjustment screw 23 is movable in a direction where the end facing the crossbar 20 gets close to or goes far from the power receiving portion 20*b* of the crossbar 20 by rotating.

The heater 24 is electrically connected to a terminal 26 through a connecting conductor plate 25.

The heater 24 is electrically connected to the circuit through the terminal 26, and heated by over-current flowing on the circuit, thereby causing the bimetallic strip 22 to bend.

The spring 21 is a torsion spring, which elastically pushes the crossbar 20 so that the crossbar 20 is rotated in one direction to trip and then in the other direction to return to the original position, with one end supported on the inner wall of a side plate forming the case of the trip mechanism and the other end supported on the crossbar 20.

The adjustment of the tripping sensitivity of the thermal trip mechanism according to the conventional art having the above-described configuration will be described with reference to FIGS. 6 to 8.

First of all, when the user uses a screwdriver to turn the adjustment dial 10 to the MIN position in the circle of FIG. 1 to set the rated current to minimum, the crossbar 20 connected through the adjustment dial 10 and the dial connecting protrusions 20*a* is moved farthest to the left, as shown in FIG. 6.

As such, the leading ends of the three adjustment screws 23 face the planar portions 20*b*-1 of the crossbar 20, respectively. Hence, a distance between the leading ends of the adjustment screws 23 and the planar portions 20*b*-1 of the crossbar 20 become a first distance G1—the minimum distance—from each other.

Accordingly, the thermal trip mechanism according to the conventional art works such that, when the current flowing through the circuit is at the minimum current rating, the leading ends of the adjustment screws 23 push the planar portions 20*b*-1 of the crossbar 20 to rotate the crossbar 20. In interlocking with this, the switching mechanism operates in the trip position (to automatically open the circuit).

In other words, the thermal trip mechanism according to the conventional art trips most sensitively at the minimum rating current.

Next, when the user uses a screwdriver to turn the adjustment dial 10 to the MED position in the circle of FIG. 1 to set the rated current to medium, the crossbar 20 connected through the adjustment dial 10 and the dial connecting protrusions 20*a* is moved a certain distance to the right from the position shown in FIG. 6, as shown in FIG. 7.

As such, the leading ends of the three adjustment screws 23 face the right ends of the slant surface portions 20*b*-2 of the crossbar 20, respectively. Hence, the distance between the leading ends of the adjustment screws 23 and the right ends of the slant surface portions 20*b*-2 of the crossbar 20 become a second distance G2—the medium distance—from each other, which is longer than the first distance G1 and shorter than a third distance G3 to be described later.

Accordingly, the thermal trip mechanism according to the conventional art works such that, when the current flowing through the circuit is at the medium current rating, the leading ends of the adjustment screws 23 push the right ends of the slant surface portions 20*b*-2 of the crossbar 20 to rotate the crossbar 20. In interlocking with this, the switching mechanism operates in the trip position (to automatically open the circuit).

In other words, the thermal trip mechanism according to the conventional art trips at the medium rating current.

Next, when the user uses a screwdriver to turn the adjustment dial 10 to the MAX in the circle of FIG. 1 to set the rated current to maximum, the crossbar 20 connected through the adjustment dial 10 and the dial connecting protrusions 20*a* is moved a certain distance further to the right from the position shown in FIG. 7, as shown in FIG. 8.

As such, the leading ends of the three adjustment screws 23 face the left ends of the slant surface portions 20*b*-2 of the crossbar 20, respectively. Hence, a distance between the leading ends of the adjustment screws 23 and the left ends of the slant surface portions 20*b*-2 of the crossbar 20 become a third distance G3—the maximum distance—from each other, which is longer than the second distance G2.

Accordingly, the thermal trip mechanism according to the conventional art works such that, when the current flowing through the circuit becomes the maximum rating current, the leading ends of the adjustment screws 23 push the left ends of the slant surface portions 20*b*-2 of the crossbar 20 to rotate the crossbar 20. In interlocking with this, the switching mechanism operates in the trip position (to automatically open the circuit).

In other words, the thermal trip mechanism according to the conventional art trips at the maximum rating current.

Referring to FIG. 4, an operation of the thermal trip mechanism according to the conventional art to thermally trip in response to over-current on the circuit will be described below.

As shown in FIG. 4, the terminal 26 is a terminal on a load side, and the current on the circuit flows through the heater 24, then through the terminal 26, then through a wire (not shown) on the load side, and then to the load side.

When the current on the circuit reaches a set value for the above-mentioned rating current, that is, a set value of the threshold current for initiating thermal tripping in response to over-current, the upper part of the bimetallic strip 22 is bent by the heat from the heater 24.

Accordingly, the power receiving portion 20*b* of the crossbar 20, spaced a distance G apart from the adjustment screw 12 fixed to the upper end of the bimetallic strip 22, rotates counterclockwise as shown in FIG. 4, pushed by the adjustment screw 23 fixed to the upper end of the bimetallic strip 22.

In interlocking with this, the switching mechanism operates in the trip position.

Referring to FIG. 9, the bimetallic strip 22 is fixed such that the lower part is attached tightly to the heater 24 by a pair of rivets R.

However, the bimetallic strip 22 may be skewed or twisted to the left or right from the center line (one-dot chain line of FIG. 9) of the heater 24 during assembly of the bimetallic strip 22 and the heater 24.

As the bimetallic strip 22 is skewed or twisted, the adjustment screw 23 attached to the upper end of the bimetallic strip 22 also is skewed or twisted in the same direction as the bimetallic strip 22.

Accordingly, there are changes in the first distance G1, second distance G2, and third distance G3 shown in FIGS. 6 to 8, compared to when there is no skewing or twisting.

Especially, the distance G from the adjustment screw 23 to the planar portion 20*b*-1 of the crossbar 20 corresponding to the MIN position setting of the adjustment dial 10 remains constant throughout the length of the planar portion 20*b*-1, from the starting point to the terminal point, whereas the distance G from the adjustment screw 23 to the slant surface portion 20*b*-2 of the crossbar 20 corresponding to the MED or MAX position setting of the adjustment dial 10 varies throughout the length of the slant surface portion 20*b*-2, from the starting point to the terminal point.

Accordingly, if the bimetallic strip 22 is skewed or twisted to the left or right from the center line (one-dot chain line of FIG. 9) of the heater 24 during assembly of the bimetallic strip 22 and the heater 24, this results in a significant difference between the distance G from the adjustment screw 23 and an intended distance, especially when the adjustment dial 10 is set to the MED or MAX position.

This causes the thermal trip mechanism according to the conventional art to an erroneous operation for over-current, and therefore the MCCB can trip at currents smaller than the set over-current trip current or does not trip even on an over-current situation until larger currents flow.

SUMMARY OF THE INVENTION

Accordingly, the present invention has been made in an effort to solve the above-described problems occurring in the conventional art, and an aspect of the present invention is to provide an adjustable thermal trip mechanism for a circuit breaker which can improve the reliability of over-current tripping by minimizing the influence of thermal tripping even if an assembly error such as skewing or twisting occurs during assembly of bimetallic strips.

The aspect of the present invention is achieved by providing an adjustable thermal trip mechanism for a circuit breaker, comprising: a crossbar that is rotatable and has at least one power receiving par for receiving rotary power; a bimetallic strip that can bend towards the power receiving portion when excess current occurs to the circuit; and an adjustment screw installed to face the power receiving portion, wherein the power receiving portion comprises a plurality of planar portions which are at different distances from the adjustment screw.

According to one aspect of the present invention, the planar portions form a step-like structure.

According to another aspect of the present invention, the plurality of planar portions comprise: a first planar portion spaced a first distance apart from the adjustment screw, corresponding to a minimum value of reference current for over-current tripping; a second planar portion spaced a second distance, longer than the first distance, apart from the adjustment screw, corresponding to a medium value of reference current for over-current tripping; and a third planar portion spaced a third distance, longer than the second distance, apart from the adjustment screw, corresponding to a maximum value of reference current for over-current tripping.

According to still another aspect of the present invention, the plurality of planar portions are configured to have different lengths.

According to still another aspect of the present invention, the crossbar is coupled to the adjustment dial so that the horizontal position of the power receiving portion is moved in interlocking with the rotation of the adjustment dial, thereby changing the distance from the adjustment screw.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

The above-described aspects of the present invention, the configuration of for accomplishing them, and its operational effects will be understood more clearly by the following description of an exemplary embodiment of the present invention with reference to the accompanying drawings.

Figure 10:
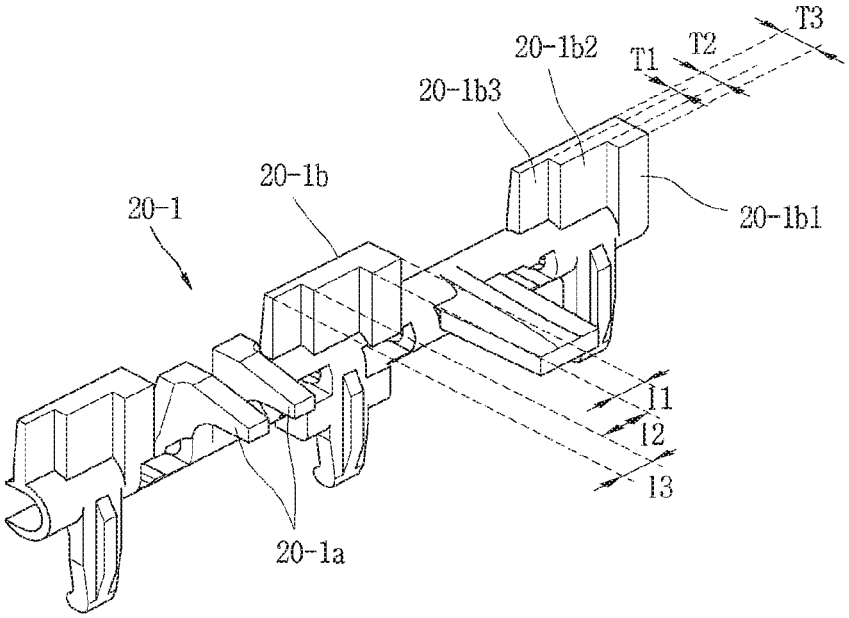
FIG. 10 is a perspective view showing the configuration of a crossbar in a thermal trip mechanism according to an exemplary embodiment of the present invention.
Figure 11:
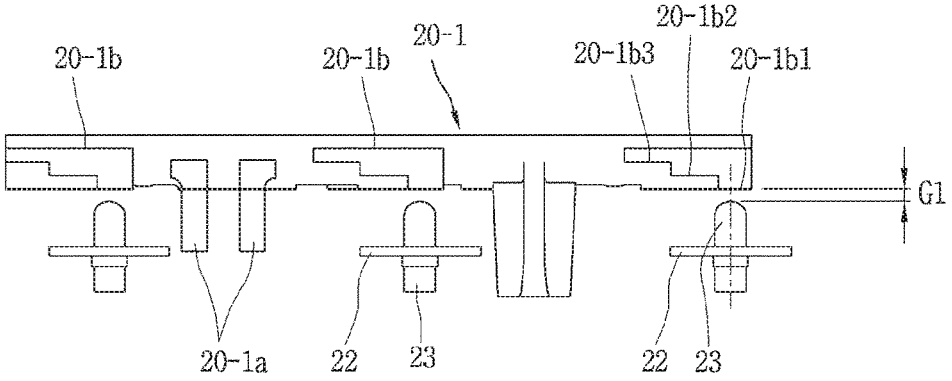
FIG. 11 is a setting status view showing the relative positions of the adjustment screw and crossbar and a shift in the position of the crossbar, when the distance between the adjustment screw and the crossbar is set to minimum by turning the adjustment dial of the thermal trip mechanism according to the present invention.
Figure 12:
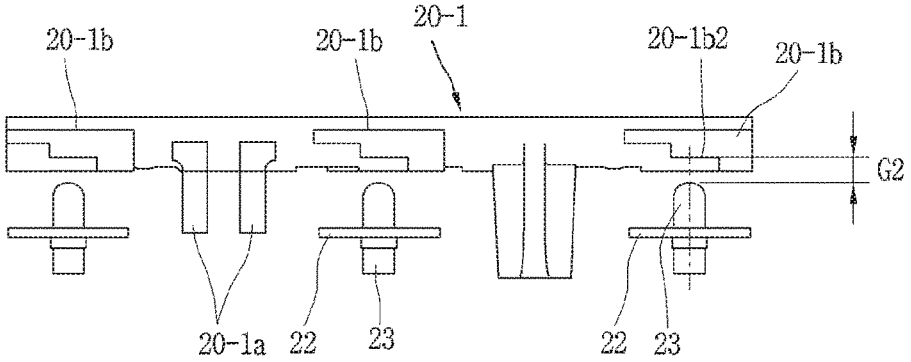
FIG. 12 is a setting status view showing the relative positions of the adjustment screw and crossbar and a shift in the position of the crossbar, when the distance between the adjustment screw and the crossbar is set to medium by turning the adjustment dial of the thermal trip mechanism according to the present invention.
Figure 13:
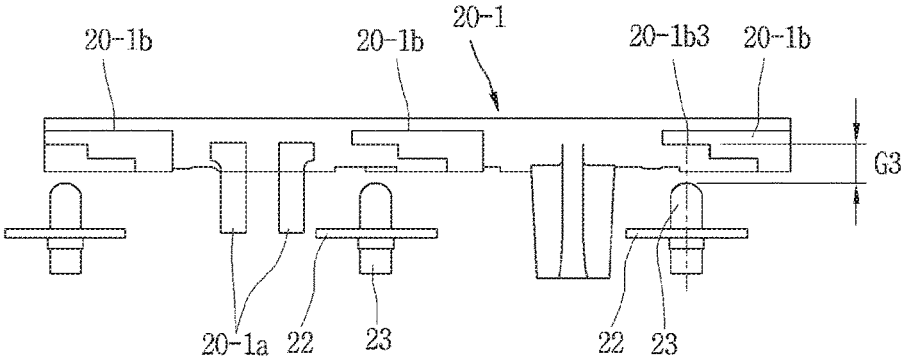
FIG. 13 is a setting status view showing the relative positions of the adjustment screw and crossbar and a shift in the position of the crossbar, when the distance between the adjustment screw and the crossbar is set to maximum by turning the adjustment dial of the thermal trip mechanism according to the present invention.

FIG. 10 is a perspective view showing the configuration of a crossbar in a thermal trip mechanism according to an exemplary embodiment of the present invention. FIG. 11 is a view showing the relative positions of the adjustment screw and crossbar and a shift in the position of the crossbar, when the distance between the adjustment screw and the crossbar is set to minimum by turning the adjustment dial of the thermal trip mechanism according to the present invention. FIG. 12 is a view showing the relative positions of the adjustment screw and crossbar and a shift in the position of the crossbar, when the distance between the adjustment screw and the crossbar is set to medium by turning the adjustment dial of the thermal trip mechanism according to the present invention. FIG. 13 is a view showing the relative positions of the adjustment screw and crossbar and a shift in the position of the crossbar, when the distance between the adjustment screw and the crossbar is set to maximum by turning the adjustment dial of the thermal trip mechanism according to the present invention.

As illustrated in the figures, an adjustable thermal trip mechanism for a circuit breaker according to an exemplary embodiment of the present invention comprises a crossbar 20-1, bimetal strips 22, and adjustment screws 23.

In addition to these components, the adjustable thermal trip mechanism according to the present invention may further comprise the adjustment dial and heaters shown and described in FIGS. 1 to 9. Other components like terminals included in a molded-case circuit breaker are the same as those shown and described in the description of the background art, so redundant explanations or explanations will be omitted.

Referring to FIG. 10, the crossbar 20-1 is rotatable, and has dial connecting protrusions 20-1*a* and at least one power receiving portion (three power receiving portions in the embodiment shown in FIG. 10) 20-1*b* for receiving rotary power.

It is assumed that, in each of the three power receiving portions 20-1*b*, the side facing the adjustment screw 23 is the front side, and the opposite side is the rear side. Referring to FIG. 10, a plurality of planar portions 20-1*b*1, 20-1*b*2, and 20-1*b*3 are formed in such a manner that the distance from the rear side to the first planar portion 20-1*b*1 is a third distance T3, which is the longest distance, the distance from the rear side to the second planar portion 20-1*b*2 is a second distance T2, which is shorter than the third distance T3, and the distance from the rear side to the third planar portion 20-1*b*3 is a first distance T1, which is shorter than the second distance T2.

Referring to FIGS. 11 to 13, each of the power receiving portions 20-1*b* comprises a plurality of planar portions 20-1*b*1, 20-1*b*2, and 20-1*b*3 which are at different distances from the adjustment screw 23.

Among the planar portions 20-1*b*1, 20-1*b*2, and 20-1*b*3, the first planar portion 20-1*b*1 is spaced a first distance G1 apart from the adjustment screw 23, corresponding to the minimum setting value of reference current for over-current tripping.

Among the planar portions 20-1*b*1, 20-1*b*2, and 20-1*b*3, the second planar portion 20-1*b*2 is spaced a second distance G2, longer than the first distance G1, apart from the adjustment screw 23, corresponding to the medium setting value of reference current for over-current tripping.

Among the planar portions 20-1*b*1, 20-1*b*2, and 20-1*b*3, the third planar portion 20-1*b*3 is spaced a third distance G3, longer than the second distance G2, apart from the adjustment screw 23, corresponding to the maximum setting value of reference current for over-current tripping.

Referring to FIG. 10, according to an exemplary embodiment of the present invention, the distances G1, G2, and G3 from the adjustment screw 23 to the planar portions 20-1*b*1, 20-1*b*2, and 20-1*b*3 form a step-like configuration throughout the lengths I1, I2, and I3, from a starting point to the terminal point.

In another exemplary embodiment of the present invention, the length I2 of the second planar portion 20-1*b*2 is longer than the length of the first planar portion 20-1*b*1 and the length I3 of the third planar portion I3. That is, I2>I1, and I2>I3.

In another exemplary embodiment, the length I2 of the second planar portion 20-1*b*2 is the longest, the length I3 of the third planar portion 20-1*b*3 is the middle, and the length I1 of the first planar portion 201*b*-1 is the shortest. That is, I2>I3>I1.

The bimetallic strips 22 are elements that can bend towards the power receiving portions 20-1*b* when over-current occurs to the circuit.

Figure 4:
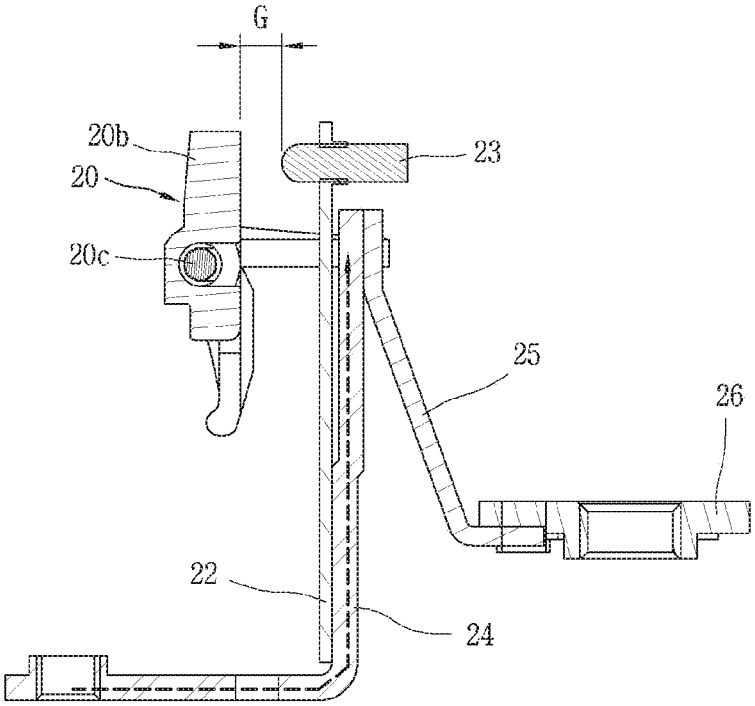
FIG. 4 PRIOR ART
FIG. 4 is a vertical cross-sectional view illustrating only the crossbar and thermal trip mechanism in the circuit breaker to which the conventional art and the present invention can be applied.
Figure 5:
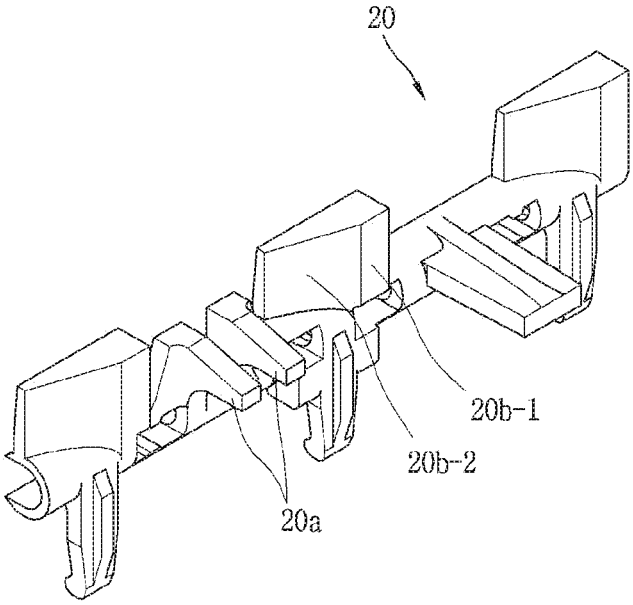
FIG. 5 PRIOR ART
FIG. 5 is a perspective view showing the configuration of the crossbar of the thermal trip mechanism according to the conventional art.
Figure 6:
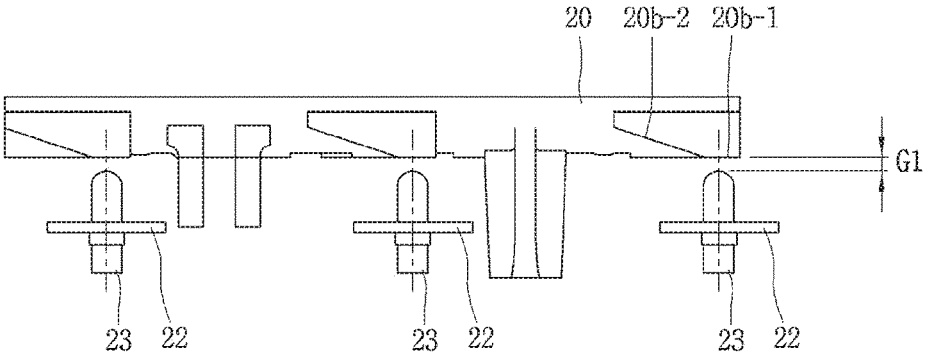
FIG. 6 PRIOR ART
FIG. 6 is a setting status view showing the relative positions of the adjustment screw and crossbar and a shift in the position of the crossbar, when the distance between the adjustment screw and the crossbar is set to minimum by turning the adjustment dial of the thermal trip mechanism according to the conventional art.
Figure 7:
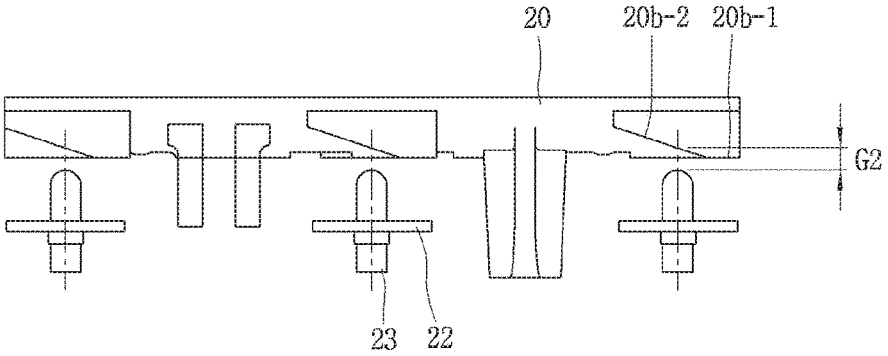
FIG. 7 PRIOR ART
FIG. 7 is a setting status view showing the relative positions of the adjustment screw and crossbar and a shift in the position of the crossbar, when the distance between the adjustment screw and the crossbar is set to medium by turning the adjustment dial of the thermal trip mechanism according to the conventional art.
Figure 8:
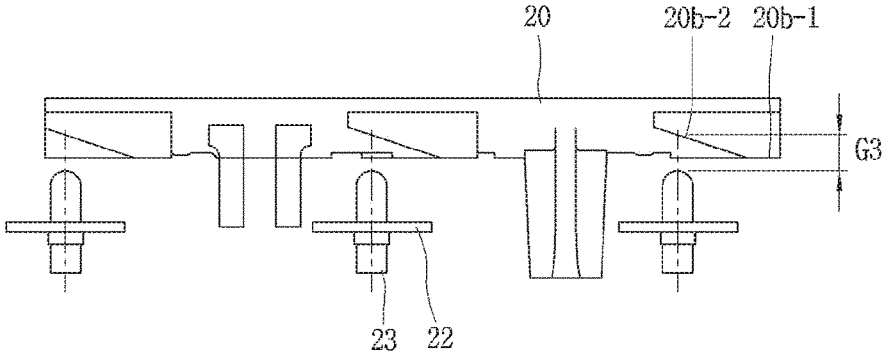
FIG. 8 PRIOR ART
FIG. 8 is a view showing the relative positions of the adjustment screw and crossbar and a shift in the position of the crossbar, when the distance between the adjustment screw and the crossbar is set to maximum by turning the adjustment dial of the thermal trip mechanism according to the conventional art.

As described with reference to FIG. 4, the bimetallic strip 22 can be attached tightly to the heater 24 and the upper part can bend freely towards the crossbar 20-1 with a predetermined distance from the heater 24.

Figure 9:
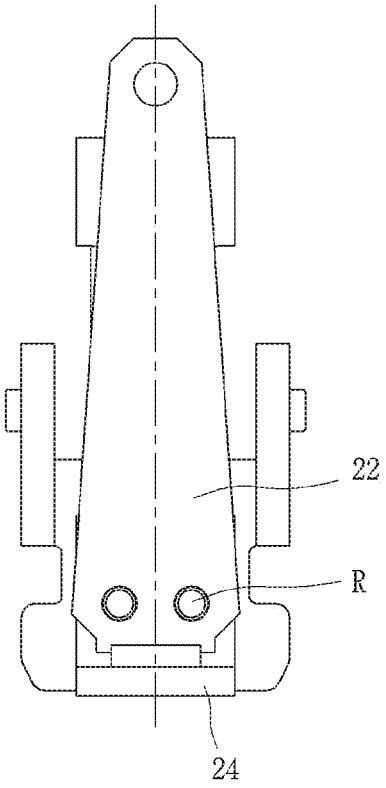
FIG. 9 PRIOR ART
FIG. 9 is a front view of a bimetal strip and a heater in the thermal trip mechanism, when the bimetal strip is skewed or twisted.

As described with reference to FIG. 9, the bimetallic strip 22 can be fixed such that the lower part is attached tightly to the heater 24 by a pair of rivets R.

The bimetallic strip 22 is thermally expanded when the heater 24 attached tightly to the lower part is heated by over-current on the circuit, and this allows the upper part, which is a free end, to bend towards the crossbar 20-1.

The bimetallic strip 22 may include a threaded hole portion at the upper end to mesh the adjustment screw 23 with the threaded hole portion.

The adjustment screw 23 is installed at the upper part of the bimetallic strip 22 so as to be movable back and forth, facing the power receiving portion 20-1*b* of the crossbar 20-1.

The adjustment screw 23 is an element for rotating the crossbar 20-1 by pushing the power receiving portion 20-1*b* when the bimetallic strip 22 bends.

The operation of the adjustable thermal trip mechanism for the circuit breaker according to an exemplary embodiment of the present invention having the above-described configuration will be described with reference to FIGS. 10 to 13.

Figure 1:
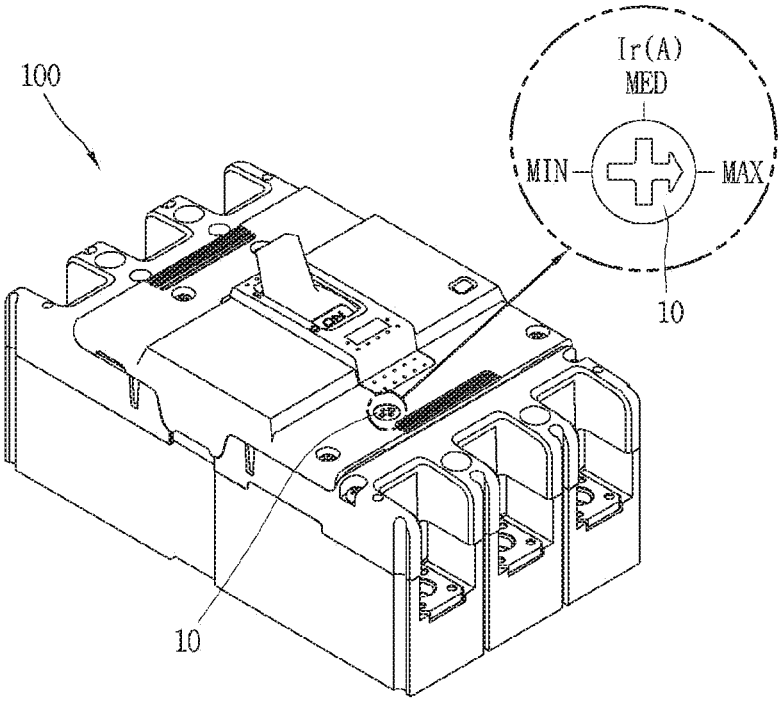
FIG. 1 PRIOR ART
FIG. 1 is a perspective view of the outward appearance of a molded-case circuit breaker to which conventional art or this invention can be applied and an enlarged view of an adjustment dial in the circle.
Figure 2:
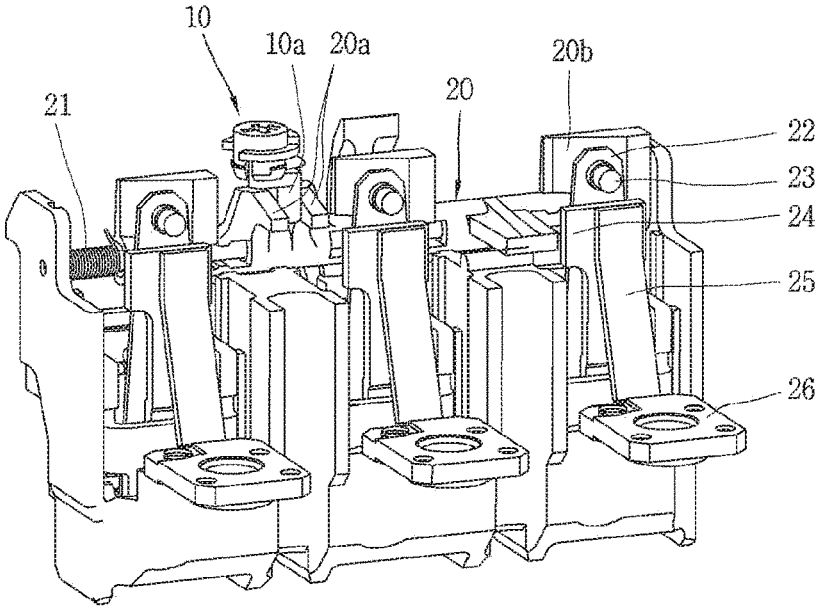
FIG. 2 PRIOR ART
FIG. 2 is a perspective view from a terminal side, illustrating only the adjustment dial, crossbar, and thermal trip mechanism in the circuit breaker to which the conventional art and the present invention can be applied.
Figure 3:
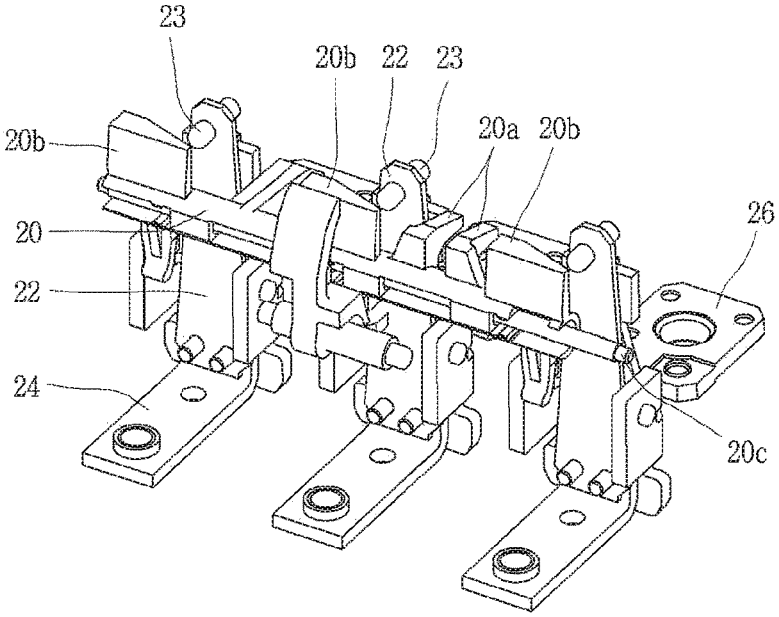
FIG. 3 PRIOR ART
FIG. 3 is a perspective view obliquely viewing down from above a heater, illustrating only the adjustment dial, crossbar, and thermal trip mechanism in the circuit breaker to which the conventional art and the present invention can be applied.

First of all, when the user uses a screwdriver to turn the adjustment dial 10 to the MIN position in the circle of FIG. 1 to set the rated current to minimum, the crossbar 20-1 connected to the adjustment dial 10 through the dial connecting protrusions 20-1*a* is moved to the farthest left, as shown in FIG. 11.

As such, the leading ends of the three adjustment screws 23 face the first planar portions 20-1*b*1 of the crossbar 20-1, respectively. Hence, the leading ends of the adjustment screws 23 and the first planar portions 20-1*b*1 of the crossbar 20-1 are at a first distance G1 which is the minimum distance from each other.

In this case, even if an assembly error such as skewing or twisting occurs during assembly of the bimetallic strips 22, the influence on the thermal tripping can be prevented without any change in the first distance G1, as long as the error is within the length of the first planar portions 20-1*b*1, thereby improving the reliability of over-current tripping.

Accordingly, the thermal trip mechanism according to the exemplary embodiment of the present invention works such that, when the current flowing through the circuit is at the minimum rated current, the leading ends of the adjustment screws 23 push the first planar portions 20-1*b*1 of the crossbar 20-1 to rotate the crossbar 20-1. In interlocking with this, the switching mechanism operates in the trip position (to automatically break the circuit).

In other words, the thermal trip mechanism according to present invention trips most sensitively at the minimum rated current.

Next, when the user uses a screwdriver to turn the adjustment dial 10 to the MED position in the circle of FIG. 1 to set the rated current to medium, the crossbar 20-1 connected to the adjustment dial 10 through the dial connecting protrusions 20-1*a* is moved a certain distance to the right from the position shown in FIG. 11, as shown in FIG. 12.

As such, the leading ends of the three adjustment screws 23 face the second planar portions 20-1*b*2 of the crossbar 20-1, respectively. Hence, the distances between the leading ends of the adjustment screws 23 and the second planar portions 20-1*b*2 of the crossbar 20-1 are a second distance G2 which is the medium distance from each other. And the second distance G2 is longer than the first distance G1 and shorter than a third distance G3 to be described later.

In this case, even if an assembly error such as skewing or twisting occurs during assembly of the bimetallic strips 22, the influence on thermal tripping can be prevented without any change in the second distance G2, as long as the error is within the length of the second planar portions 20-1*b*2, thereby improving the reliability of over-current tripping.

Accordingly, the thermal trip mechanism according to the exemplary embodiment of the present invention works such that, when the current flowing through the circuit reach the medium rated current, the leading ends of the adjustment screws 23 push the second planar portions 20-1*b*2 of the crossbar 20-1 to rotate the crossbar 20-1. In interlocking with this, the switching mechanism operates in the trip position (to automatically break the circuit).

In other words, the thermal trip mechanism according to the exemplary embodiment of the present invention trips at the medium rated current.

Next, when the user uses a screwdriver to turn the adjustment dial 10 to the MAX position in the circle of FIG. 1 to set the rated current to maximum, the crossbar 20-1 connected to the adjustment dial 10 through the dial connecting protrusions 20-1*a* is moved a certain distance further to the right from the position shown in FIG. 12, as shown in FIG. 13.

As such, the leading ends of the three adjustment screws 23 face the third planar portions 20-1*b*3 of the crossbar 20-1, respectively. Hence, the distance between the leading ends of the adjustment screws 23 and the third planar portions 20*b*-2 of the crossbar 20-1 are a third distance G3 which the maximum distance from each other And the third distance G3 is longer than the second distance G2.

In this case, even if an assembly error such as skewing or twisting occurs during assembly of the bimetallic strips 22, the influence upon thermal tripping can be prevented as there is no change in the third distance G3, as long as the error is within the length of the third planar portions 20-1*b*3, thereby improving the reliability of over-current tripping.

Accordingly, the thermal trip mechanism according to the exemplary embodiment of the present invention works such that, when the current flowing through the circuit is at the maximum rated current, the leading ends of the adjustment screws 23 push the third planar portions 20-1*b*3 of the crossbar 20-1 to rotate the crossbar 20-1. In interlocking with this, the switching mechanism operates to the trip position (to automatically break the circuit).

In other words, the thermal trip mechanism according to the exemplary embodiment of the present invention trips at the maximum rated current.

As described above, in the adjustable thermal trip mechanism for the circuit breaker according to the present invention, each power receiving portion of the crossbar comprises a plurality of planar portions which are at different distances from the adjustment screw. Thus, even if an assembly error such as skewing or twisting occurs during assembly of the bimetal strips, the influence upon thermal tripping can be prevented, as long as the error is within the length of each planar portion. Therefore, the reliability of over-current tripping can be improved.

In the adjustable thermal trip mechanism for the circuit breaker according to the present invention, the planar portions form a step-like configuration. Thus, even if an assembly error such as skewing or twisting occurs during assembly of the bimetal strips, the influence upon thermal tripping can be prevented, as long as the error is within the area of the same stepped portion. Therefore, the reliability of over-current tripping can be improved.

In the adjustable thermal trip mechanism for the circuit breaker according to the present invention, the plurality of planar portions comprise a first planar portion spaced a first distance apart from the adjustment screw, a second planar portion spaced a second distance, longer than the first distance, apart from the adjustment screw, and a third planar portion spaced a third distance, longer than the second distance, apart from the adjustment screw. Thus, over-current tripping can be performed, corresponding to the maximum, medium, and minimum values of reference current for over-current tripping. Thus, even if an assembly error such as skewing or twisting occurs during assembly of the bimetal strips, the influence upon thermal tripping can be prevented, as long as the error is within the lengths of the first, second, and third planar portions, since there are no changes in the first, second, and third distances. Therefore, the reliability of over-current tripping can be improved.

In the adjustable thermal trip mechanism for the circuit breaker according to the present invention, the plurality of planar portions have different lengths, especially the second planar portion has the longest length. Thus, setting the rated current to the medium value of reference current for over-current tripping can widen the area where there is no change in the second distance even if an assembly error such as skewing or twisting occurs during assembly of the bimetal strips. Therefore, the influence upon thermal tripping can be prevented, and the reliability of over-current tripping can be improved.

In the adjustable thermal trip mechanism for the circuit breaker according to the present invention, the crossbar is coupled to the adjustment dial. Thus, the horizontal position of the power receiving portions can be moved in interlocking with the rotation of the adjustment dial, thereby changing the distance from the adjustment screw.

What is claimed is:

1. An adjustable thermal trip mechanism for a circuit breaker, comprising:

a crossbar that is rotatable and has at least one power receiving portion for receiving rotary power;

a bimetallic strip that can bend towards the at least one power receiving portion when an over current occurs on the circuit; and an adjustment screw installed to face the at least one power receiving portion, wherein the at least one power receiving portion comprises a plurality of planar portions which are at different distances from the adjustment screw, wherein the plurality of planar portions comprise:

a first planar portion spaced a first distance apart from the adjustment screw, corresponding to a minimum value of reference current for over-current tripping, wherein the first planar portion has a first horizontal length;

a second planar portion spaced a second distance, longer than the first distance, apart from the adjustment screw, corresponding to a medium value of reference current for over-current tripping, wherein the second planar portion has a second horizontal length longer than the first horizontal length of the first planar portion; and a third planar portion spaced a third distance, longer than the second distance, apart from the adjustment screw, corresponding to a maximum value of reference current for over-current tripping, wherein the third planar portion has a third horizontal length shorter than the second horizontal length of the second planar portion, and wherein the crossbar is coupled directly to an adjustment dial without any intervening element so that a horizontal position of the at least one power receiving portion is moved as the adjustment dial rotates, thereby changing the distance from the adjustment screw.

2. The adjustable thermal trip mechanism of claim 1, wherein the planar portions have a step-like configuration.

* * * * *